US010273860B2

(12) United States Patent
Ikeda et al.

(10) Patent No.: US 10,273,860 B2
(45) Date of Patent: Apr. 30, 2019

(54) EXHAUST APPARATUS FOR VEHICLE

(71) Applicant: KOBELCO CONSTRUCTION MACHINERY CO., LTD., Hiroshima-shi (JP)

(72) Inventors: Taisuke Ikeda, Hiroshima (JP); Masaaki Tateyama, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 57 days.

(21) Appl. No.: 15/450,438

(22) Filed: Mar. 6, 2017

(65) Prior Publication Data

US 2017/0284270 A1 Oct. 5, 2017

(30) Foreign Application Priority Data

Mar. 29, 2016 (JP) ..... 2016-065888

(51) Int. Cl.
*F01N 3/00* (2006.01)
*F01N 13/00* (2010.01)
*F01N 13/08* (2010.01)

(52) U.S. Cl.
CPC ..... *F01N 13/008* (2013.01); *F01N 13/009* (2014.06); *F01N 13/082* (2013.01);
(Continued)

(58) Field of Classification Search
CPC .... F01N 13/008; F01N 13/009; F01N 13/082; F01N 2560/026; F01N 2590/08; F01N 2900/1402
(Continued)

(56) References Cited

U.S. PATENT DOCUMENTS 4,656,830 A 4/1987 Ohno et al.
8,696,777 B1 4/2014 Patil et al.
(Continued)

FOREIGN PATENT DOCUMENTS

JP 61-261617 A 11/1986
JP 2002-122486 A 4/2002
(Continued)

OTHER PUBLICATIONS

Office Action dated Jan. 23, 2018 in Japanese Patent Application No. 2016-065888 with English summary Obtained from the EPO Global Dossier, citing documents AO-AQ therein, 8 pages.
(Continued)

*Primary Examiner* — Phutthiwat Wongwian
*Assistant Examiner* — Diem Tran
(74) *Attorney, Agent, or Firm* — Oblon, McClelland, Maier & Neustadt, L.L.P

(57) ABSTRACT

Provided is an exhaust apparatus for a vehicle, being capable of performing a normal detection of a nitrogen oxide (NOx) concentration in exhaust gas without involving increase in the size and the cost. The exhaust apparatus includes an exhaust pipe having an upstream end connected to an aftertreatment device and a downstream end enclosing an exhaust port at a position higher than the upstream end, a NOx sensor to be retained in the exhaust pipe, and a water barrier wall provided inside the exhaust pipe. The water barrier wall has a shape to form a shield between the NOx sensor and the exhaust port while leaving a gas inlet that allows the exhaust gas to flow to the NOx sensor from the aftertreatment device through the gas inlet.

10 Claims, 9 Drawing Sheets

(52) U.S. Cl.
CPC .... *F01N 2560/026* (2013.01); *F01N 2590/08* (2013.01); *F01N 2900/1402* (2013.01)

(58) Field of Classification Search
USPC ..... 60/276, 301
See application file for complete search history.

(56) References Cited

U.S. PATENT DOCUMENTS

| | | | | |
|---|---|---|---|---|
| 2002/0039378 | A1 | 4/2002 | Shibayama | |
| 2004/0159547 | A1* | 8/2004 | Haraguchi | G01N 33/0037 204/424 |
| 2010/0024524 | A1* | 2/2010 | Ebner | G01N 27/4077 73/31.05 |
| 2010/0064663 | A1 | 3/2010 | Goya | |
| 2012/0089278 | A1* | 4/2012 | Goes | B61C 5/02 701/19 |
| 2013/0161112 | A1 | 6/2013 | Grzesiak et al. | |
| 2014/0331656 | A1 | 11/2014 | Adupala et al. | |
| 2015/0160102 | A1* | 6/2015 | Denis | F01N 3/2066 60/301 |
| 2015/0354431 | A1* | 12/2015 | Denis | F01N 13/008 73/866.5 |

FOREIGN PATENT DOCUMENTS

| | | | |
|---|---|---|---|
| JP | 2010-7556 | | 1/2010 |
| JP | 2010-270710 | A | 12/2010 |
| JP | 2014-9615 | A | 1/2014 |
| JP | 2014-163237 | | 9/2014 |
| WO | WO 2009/040641 | A1 | 4/2009 |
| WO | WO 2014/084959 | A1 | 6/2014 |

OTHER PUBLICATIONS

Extended European Search Report dated Jun. 21. 2017 in Patent Application No. 17158310.7.

* cited by examiner

EXHAUST APPARATUS FOR VEHICLE

TECHNICAL FIELD

The present invention relates to an exhaust apparatus for purifying exhaust gas from vehicles with engines, for example general vehicles, transporting vehicles, and travelling working machines such as hydraulic excavators, and releasing the purified gas into the atmosphere.

BACKGROUND ART

JP 2014-163237 A discloses a conventionally known exhaust apparatus mounted on a vehicle with an engine. The exhaust apparatus disclosed in JP 2014-163237 A includes an aftertreatment device configured to purify exhaust gas emitted from an engine, an exhaust pipe through which the exhaust gas treated by the aftertreatment device is released into the atmosphere, and a nitrogen oxide (NOx) sensor mounted on the exhaust pipe. The NOx sensor detects a NOx concentration in the exhaust gas to be released into the atmosphere. The detection results are utilized for operation control of the aftertreatment device (for example, control of injection quantity of urea water for reduction of NOx) or utilized as information for diagnosing failure or deterioration of the aftertreatment device.

However, NOx sensors are typically weak to water. For example, in a widely used NOx sensor equipped with a sensing portion containing ceramics such as zirconia, adhesion of water to a surface of the ceramics may result in a crack in the worst case, because evaporation of the water on the surface of the ceramics generates latent heat, thereby generating a possibility of large thermal stress in the ceramics. Moreover, since the NOx sensor is typically provided on an exhaust pipe that is communicated with the atmosphere, rain water or high-pressure cleaning water, for example, may enter the exhaust pipe and reach the NOx sensor. In view of the above, it is an important issue to protect the NOx sensor from moisture.

In this regard, the exhaust pipe disclosed in JP 2014-163237 A can effectively protect the NOx sensor from adhesion of external water such as rain water, because the exhaust pipe is formed in a U-shape with an intermediate part between upstream and downstream ends thereof, the intermediate part being the lowest part, and the NOx sensor is provided on the downstream end which is positioned higher than the intermediate part. The exhaust pipe, however, has to have a long passage length and a complicated shape in order to locate the intermediate part at a lower position than the other parts, thus involving significant increase in the size and in the cost of the apparatus.

SUMMARY OF INVENTION

An object of the present invention is to provide an exhaust apparatus for a vehicle, the exhaust apparatus being capable of normally detecting a nitrogen oxide (NOx) concentration in the exhaust gas for an aftertreatment of the exhaust gas without involving a significant increase in the size and the cost of the apparatus.

Provided is an exhaust apparatus to be equipped on a vehicle with an engine to give an aftertreatment to exhaust gas emitted from the engine and to release thereafter the treated exhaust gas into the atmosphere, the exhaust apparatus including: an aftertreatment device connected to the engine and configured to give the aftertreatment to the exhaust gas emitted from the engine; an exhaust pipe having an upstream end connected to the aftertreatment device and a downstream end enclosing an exhaust port at a position higher than the upstream end; a NOx sensor that includes a sensing portion configured to generate a detection signal relating to a NOx concentration in the exhaust gas, through contact with the exhaust gas, the NOx sensor being retained in the exhaust pipe so as to locate the sensing portion inside the exhaust pipe; and a water barrier wall disposed inside the exhaust pipe and having a shape to form a shield between the NOx sensor and the exhaust port while leaving a gas inlet that allows the exhaust gas to flow to the NOx sensor from the downstream end of the exhaust pipe through the gas inlet.

DESCRIPTION OF EMBODIMENTS

Figure 1:
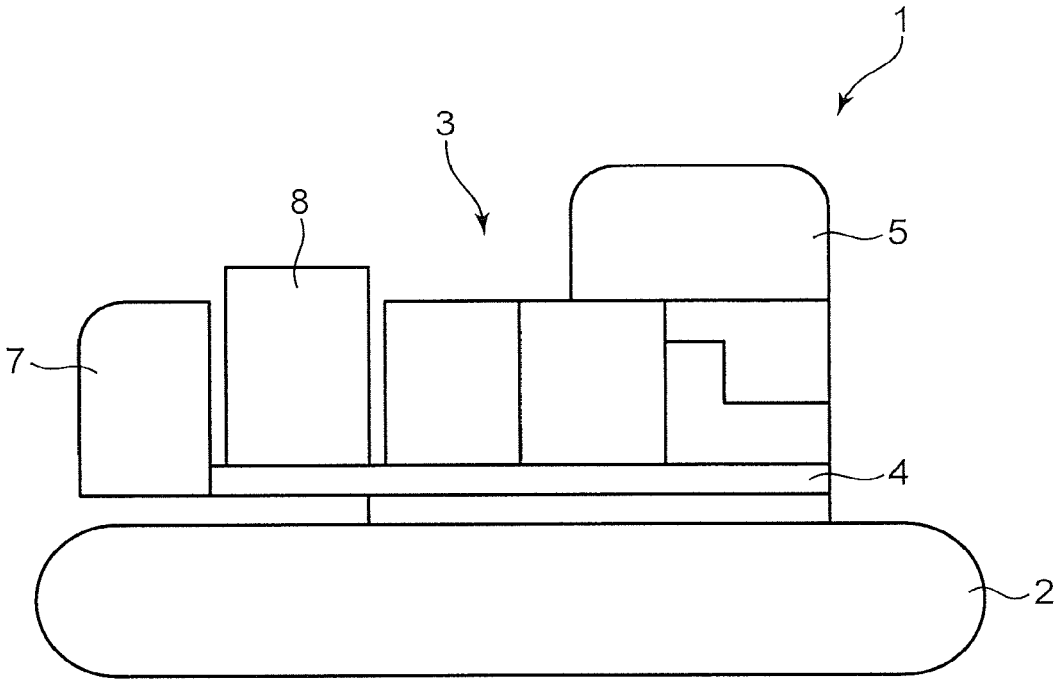
FIG. 1 is a right side view of a hydraulic excavator as a vehicle according to an embodiment of the present invention.
Figure 2:
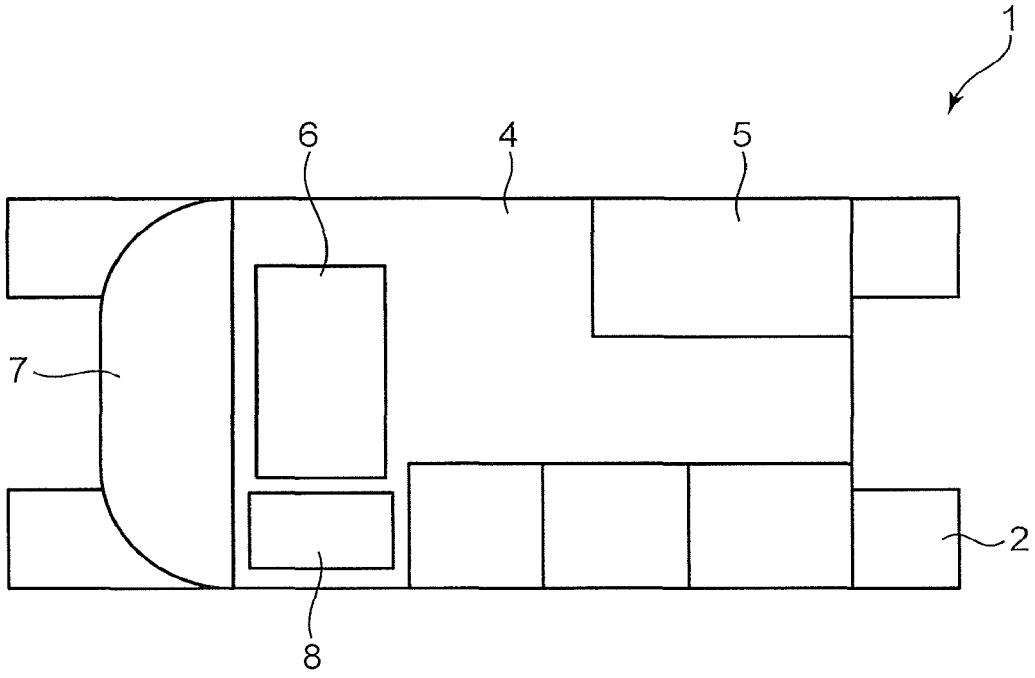
FIG. 2 is a plan view of the hydraulic excavator.

Preferred embodiments of the present invention are described below with reference to the drawings. Although the embodiments explained below are directed to a travelling working machine, specifically a hydraulic excavator 1 as shown in FIGS. 1 and 2 to which the present invention is applied, vehicles to which the present invention is applicable are not limited to the hydraulic excavator. In addition to the hydraulic excavator, the present invention can be widely applied to, for example, travelling working machines other than hydraulic excavators (crushers, self-propelling type cranes, and the like), transporting vehicles such as trucks, general vehicles, and other vehicles.

As shown in FIGS. 1 and 2, the hydraulic excavator 1 includes a crawler-type lower travelling body 2, an upper slewing body 3 mounted on the lower travelling body 2 so as to be slewable, and a working attachment not-graphically-shown attached to the upper slewing body 3 so as to be able to be raised and lowered. The upper slewing body 3 includes a base frame 4 provided on the lower travelling body 2 and a plurality of components provided on the base frame 4, the components including a cabin 5, an engine 6, a counter weight 7, and an exhaust apparatus 8. The upper slewing body 3 has a front-rear direction and a right-left direction which correspond to a front-rear direction and a right-left direction as viewed from an operator seated on an operator seat in a cabin 5, respectively.

The engine 6 has a longitudinal direction and is mounted on the rear part of the base frame 4 in a lateral attitude in which the longitudinal direction coincides with the right-left direction of the upper slewing body 3. To the engine 6 is joined a not-graphically-shown hydraulic pump to be driven by the power of the engine 6.

Figure 3:
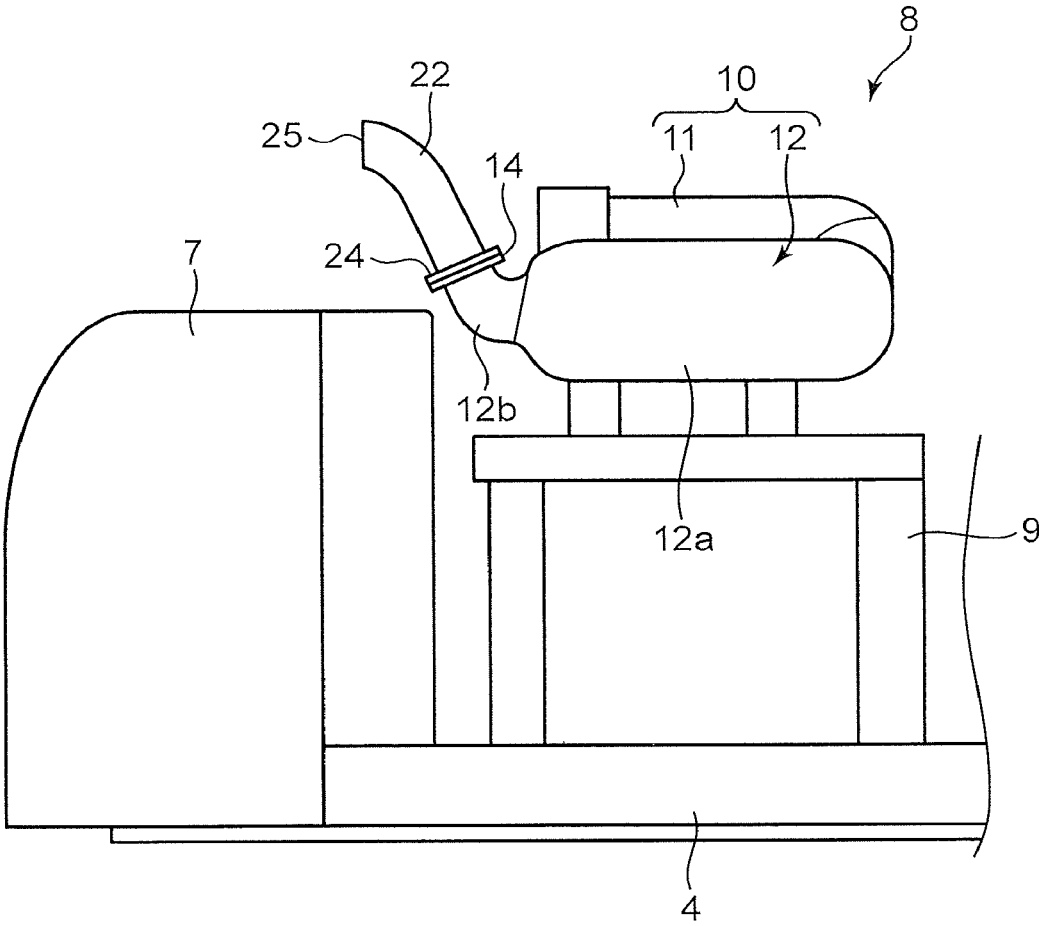
FIG. 3 is a right side view of a rear part of an upper slewing body of the hydraulic excavator.

The exhaust apparatus 8 gives the exhaust gas emitted from the engine 6 an aftertreatment (purification treatment) and releases the treated gas into the atmosphere. The exhaust apparatus 8 includes a not-graphically-shown muffler, an aftertreatment device 10 shown in FIGS. 3 and 4, an exhaust pipe 20 shown in FIGS. 3 to 6, a nitrogen oxide (NOx) sensor 30 shown in FIGS. 4 to 9, and a water barrier wall 40 shown in FIGS. 6 to 9.

The aftertreatment device 10, which is configured to perform the aftertreatment, includes a first processing section 11 and a second processing section 12 that are arranged in series and disposed on a stand 9 fixed on the base frame 4. The stand 9 defines an accommodation area under the first and second processing sections 11, 12, and equipment other than the aftertreatment device 10, for example, the hydraulic pump, is disposed in the accommodation area.

Figure 4:
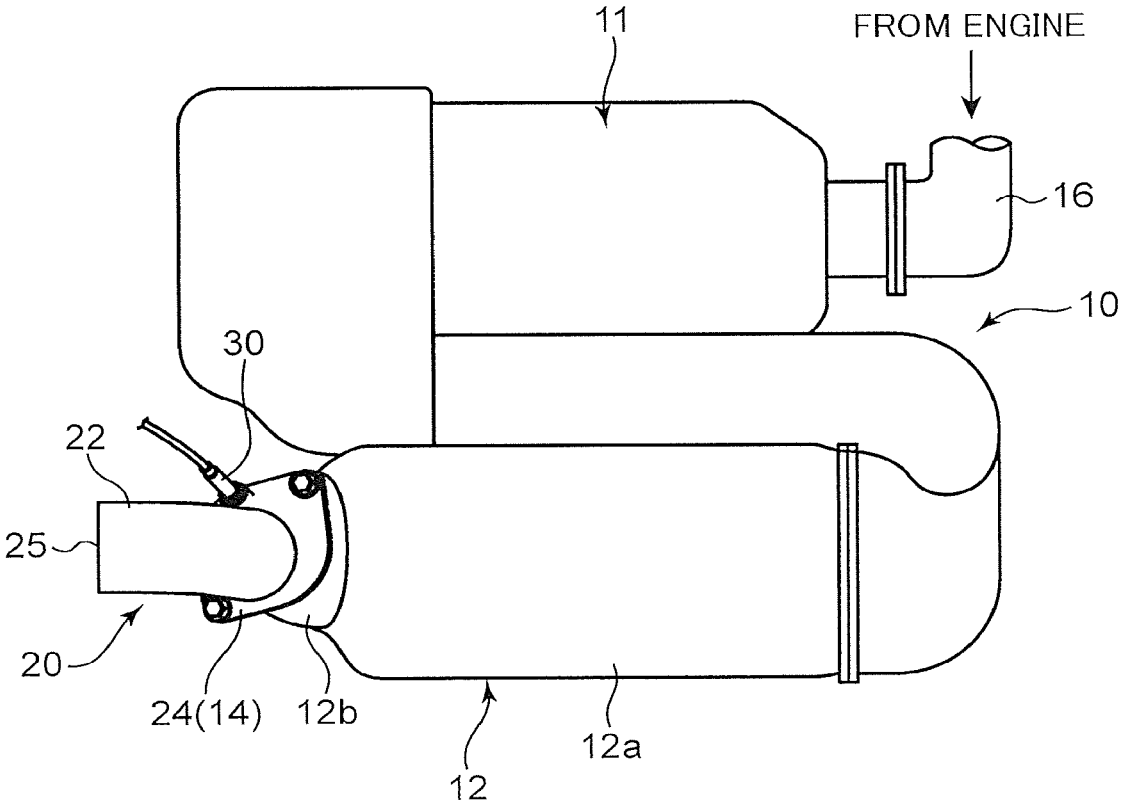
FIG. 4 is a plan view of an exhaust apparatus provided at the rear part of the upper slewing body.
Figure 5:
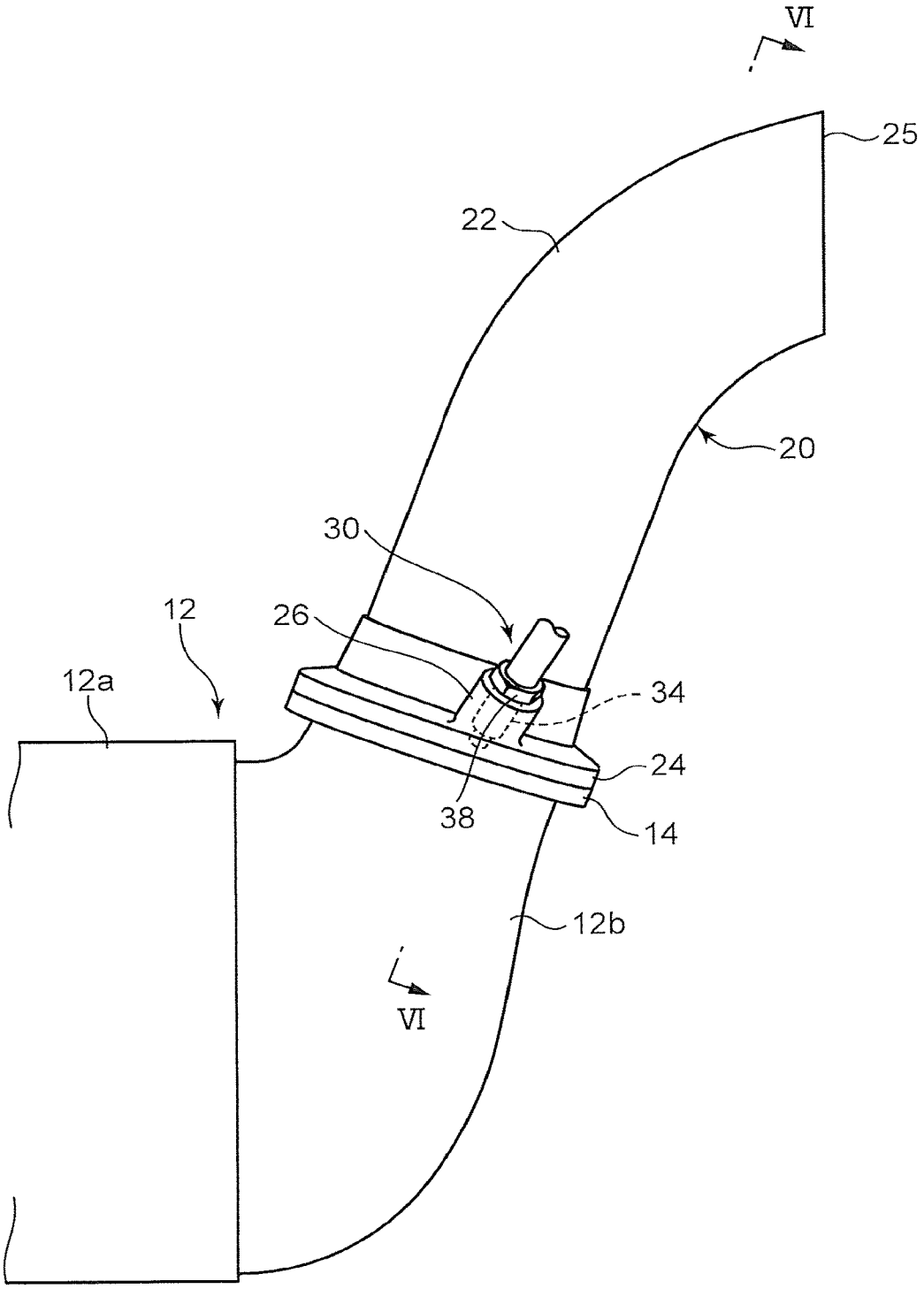
FIG. 5 is a left side view of an exhaust pipe of the exhaust apparatus and a nitrogen oxide (NOx) sensor retained in the exhaust pipe.
Figure 6:
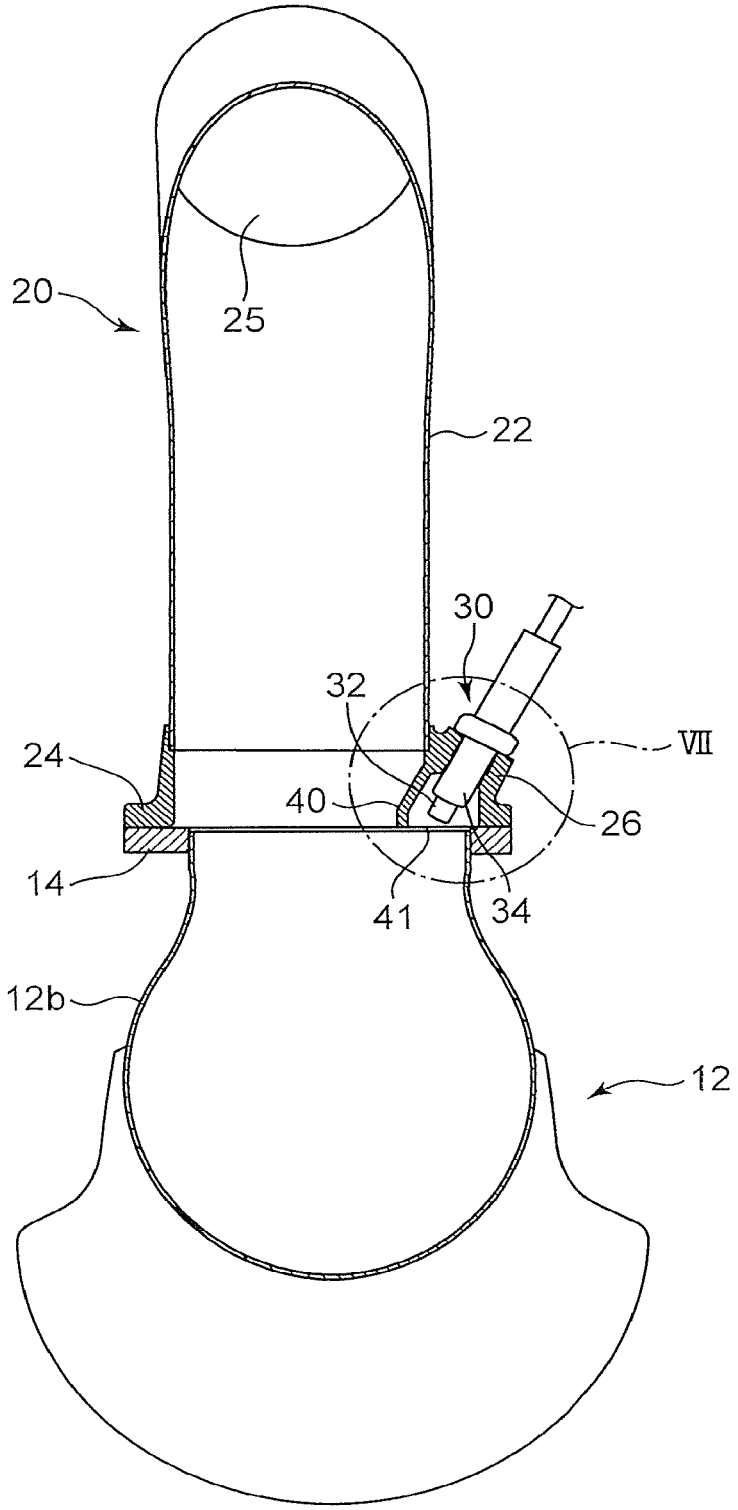
FIG. 6 is a cross-sectional view taken along line VI-VI in FIG. 5.

The first processing section 11 is connected to the engine 6 through a connection pipe 16 shown in FIG. 4 to directly receives the exhaust gas emitted from the engine 6. The first processing section 11 possesses a filter (Diesel Particulate Filter: hereinafter referred to as "DPF") for purifying the exhaust gas. The DPF has an ability of capturing dust particles, such as soot included in the exhaust gas emitted from the engine 6. The DPF is regenerable by burning of the captured dust particles at high-temperatures.

The second processing section 12 is disposed downstream of the first processing section 11 to receive the exhaust gas from the first processing section 11. The second processing section 12 forms a so-called urea SCR (Selective Catalytic Reduction) system. The urea SCR system includes an injector configured to inject urea water into the exhaust gas, and an SCR catalyst disposed downstream of the injector and configured to accelerate an oxidation-reduction reaction between ammonia, which is produced through hydrolysis of urea water under high temperatures, and the nitrogen oxides (NOx) in the exhaust gas to render the nitrogen oxides harmless.

The exhaust pipe 20 is a so-called tail pipe, forming a passage for releasing, into the atmosphere, the exhaust gas having got the aftertreatment from the first and second processing sections 11, 12. Specifically, the exhaust pipe 20 includes an exhaust pipe body 22, which has a substantially constant diameter, and a flange portion 24.

The flange portion 24 forms an upstream end of the exhaust pipe 20, i.e., an end connected to an outlet of the second processing section 12. Specifically, the second processing section 12 includes: a processing section body 12*a* extending in the front-rear direction (right-left direction in FIG. 4) of the upper slewing body 3 and; an outlet part 12*b* extending diagonally upward from the end on the outlet side of the processing section body 12*a* (an end on the left side in FIG. 4), being formed with a flange 14 in the end of the outlet part 12*b*. On the other hand, the flange portion 24 of the exhaust pipe 20 has a thickness larger than that of the exhaust pipe body 22 and projects outward beyond the outer peripheral surface of the exhaust pipe body 22, having a shape capable of being detachably fastened to the flange 14 of the outlet part 12*b* with a plurality of bolts not-graphically-shown.

The exhaust pipe body 22 has a shape extending diagonally upward from the flange portion 24. The exhaust pipe body 22 has a downstream end opposite to the flange portion 24, the downstream end enclosing an exhaust port 25 at a position higher than the flange portion 24. The exhaust port 25 according to this embodiment is directed backward in the front-rear direction of the upper slewing body 3, while the direction of the exhaust port 25 can be set freely.

The NOx sensor 30 is configured to generate a NOx concentration detection signal which is an electric signal corresponding to a NOx concentration in the exhaust gas, including a sensing portion 32, a body portion 34, and a sensor cover 36.

The sensing portion 32 generates a NOx concentration detection signal through contact with the exhaust gas. The sensing portion 32 is formed of, for example, a layered structure of a zirconia ($ZrO_2$) solid electrolyte. The sensing portion 32 is, therefore, weak to water, thus requiring the protection of the surface thereof from water for normal operation thereof.

The body portion 34 is a portion to be retained in the exhaust pipe 20 while holding the sensing portion 32. The body portion 34 has a cylindrical outer peripheral surface formed with a male thread in a specific part thereof, the male thread allowing a nut 38 to be attached thereto as shown in FIGS. 5 to 8.

Figure 7:
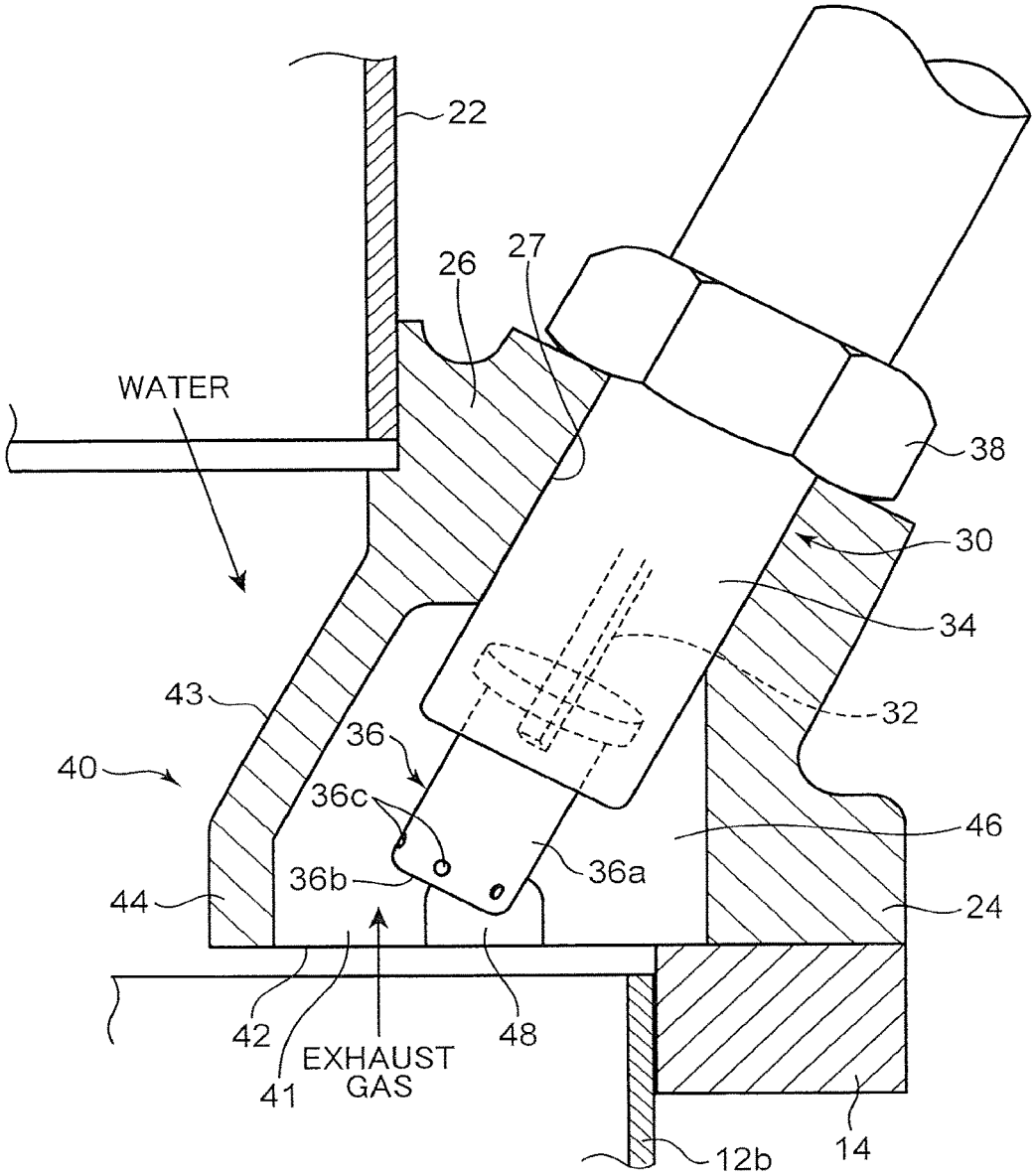
FIG. 7 is an enlarged view of a part enclosed in circle VII in FIG. 6.
Figure 8:
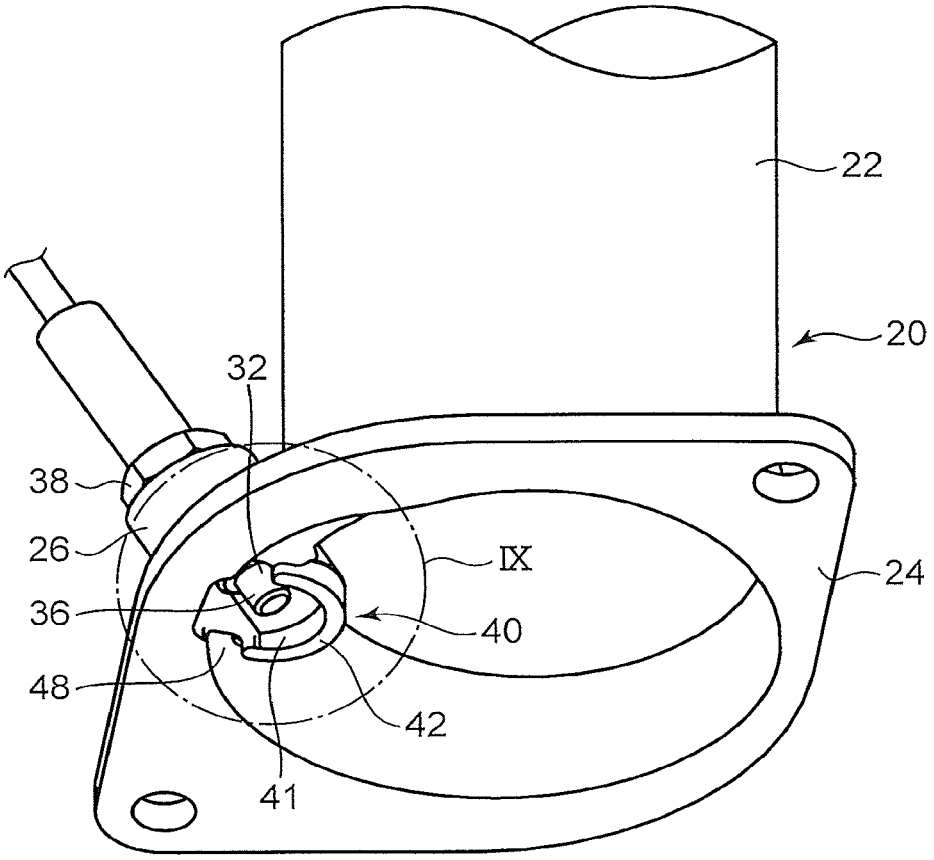
FIG. 8 is a bottom perspective view of the exhaust pipe.
Figure 9:
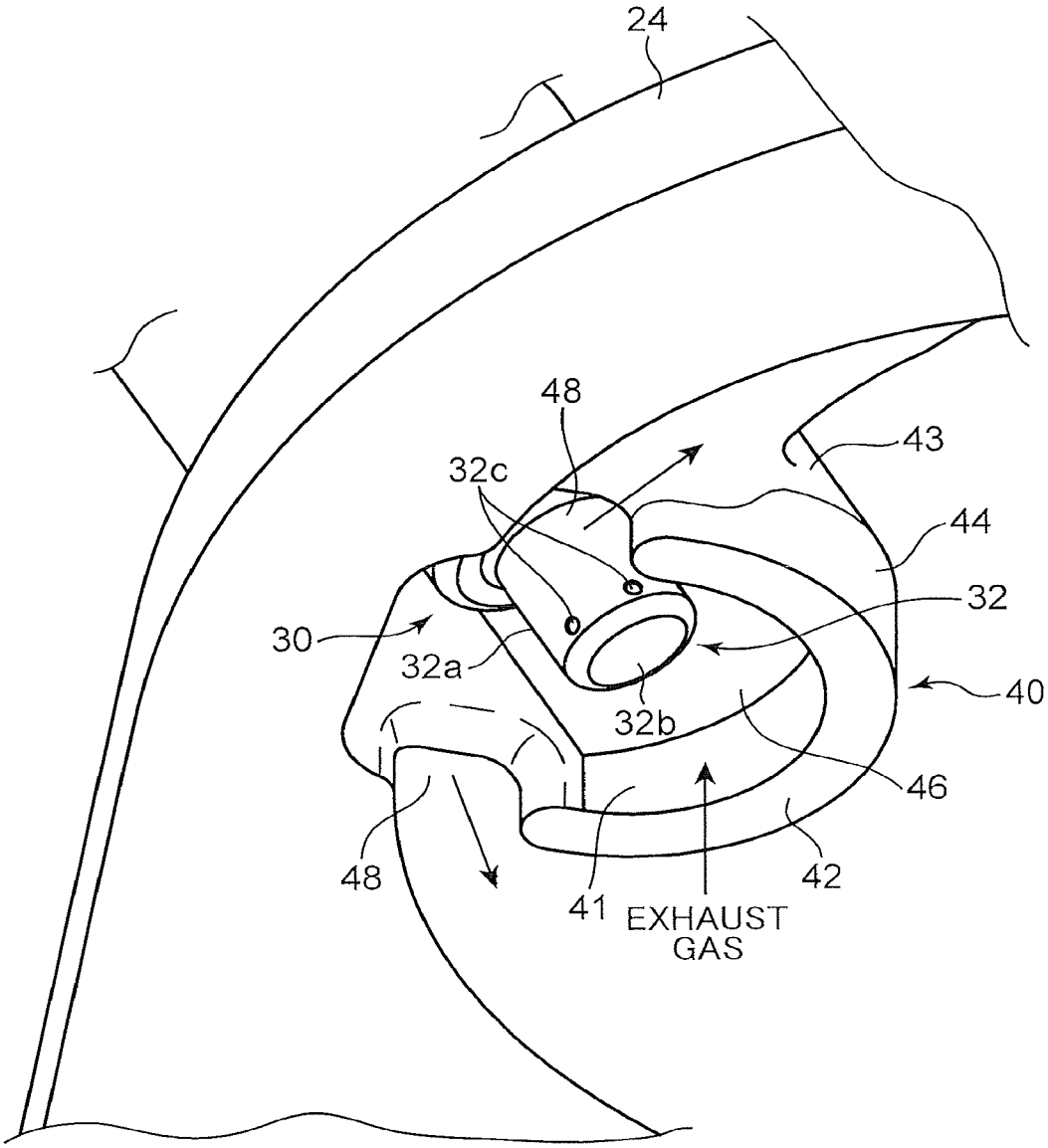
FIG. 9 is an enlarged view of a part enclosed in circle IX in FIG. 8.

The sensor cover 36 is positioned closer to an end of the NOx sensor 30 than the sensing portion 32 to cover the sensing portion 32. Specifically, as shown in FIGS. 7 and 9, the sensor cover 36 integrally includes a cylindrical peripheral wall 36*a* with an outer diameter smaller than that of the body portion 34 and an end wall 36*b* closing the end of the peripheral wall 36*a*. The peripheral wall 36*a* is formed with a plurality of through holes 36*c* in the vicinity of the end of the peripheral wall 36*a* to allow the external exhaust gas to enter the sensor cover 36 through the through holes 36*c*.

The NOx sensor 30 is retained in the exhaust pipe 20 so as to bring the sensing portion 32 into communication with the space inside the exhaust pipe 20. Specifically, the NOx sensor 30 is retained in the exhaust pipe 20 in such an attitude that the sensor cover 36 positioned closer to the end of the NOx sensor 30 than the sensing portion 32 is below the sensing portion 32, namely, a downward attitude (a diagonally downward attitude in this embodiment). This is to prevent water the condensed on the surface (particularly inside surface) of the sensor cover 36 from reaching the sensing portion 32 without evaporation.

The exhaust pipe 20 includes a sensor retention portion 26 that retains the NOx sensor 30. The sensor retention portion 26 is formed in the flange portion 24 with the above-described large thickness. The sensor retention portion 26 has a cylindrical shape defining a sensor insertion hole 27 thereinside. The sensor insertion hole 27 has a diameter that allows the body portion 34 of the NOx sensor 30 to be pressed into the sensor insertion hole 27 from the outside while the sensor cover 36 is directed downward. The mounting position of the NOx sensor 30 can be fixed by tightening the nut 38 to the male thread in a state where the body portion 34 is pressed into the sensor insertion hole 27. The mounting position is determined so as to locate at least the sensing portion 32 and the sensor cover 36 of the NOx sensor 30 inside the exhaust pipe 20. The axial direction of the sensor insertion hole 27, i.e., the direction of the center axis of the NOx sensor 30 retained in the sensor retention portion 26, is set in a direction slightly inclined to the center axis of the exhaust pipe 20.

Respective materials of which the exhaust pipe 20 and the body portion 34 and the sensor cover 36 of the NOx sensor 30 are made can be selected as appropriate. Preferably, at least the sensor retention portion 26 of the exhaust pipe 20 and a portion retained in the sensor retention portion 26 in the NOx sensor 30 (the body portion 34 in this embodiment)

are formed of materials having respective linear expansion coefficients equal to each other (for example, the same stainless steel materials). This prevents excess or deficiency of retention force of the sensor retention portion 26 for retaining the NOx sensor 30 from being caused by the difference between the linear expansion coefficients. Specifically, this prevents the radial expansion of the sensor insertion hole 27 of the sensor retention portion 26 from exceeding that of the body portion 34 to thereby decrease the retention force of the sensor retention portion 26 for retaining the body portion 34, or conversely, prevents the radial expansion of the body portion 34 from exceeding that of the sensor insertion hole 27 to thereby produce an excessive stress in the body portion 34.

The water barrier wall 40 is provided inside the exhaust pipe 20 and has a shape to form a shield between the NOx sensor 30 and the exhaust port 25 (of the exhaust pipe 20) positioned above the NOx sensor 30 while leaving a gas inlet that allows the exhaust gas to flow to the NOx sensor 30 through the gas inlet from the upstream end of the exhaust pipe 20. Specifically, the water barrier wall 40 is joined with the flange portion 24 of the exhaust pipe 20 to define, in association with the flange portion 24, a gas entry space 46 around the NOx sensor 30. The water barrier wall 40 has a lower end 42 enclosing an opening 41 which is directed downward and a part located higher than the lower end 42, the part having a shape to cover the NOx sensor 30 on upper side of the NOx sensor 30 and radially (of the exhaust pipe 20) inner side of the NOx sensor 30 (the left side in FIG. 7, the right side in FIG. 9).

The lower end 42 according to the embodiment has a substantially semicircular shape surrounding the end of the NOx sensor 30 as viewed from the bottom. The opening 41 defined by the lower end 42 corresponds to the gas inlet allowing the exhaust gas to enter the gas entry space 46 through the gas inlet from the space beneath the gas entry space 46.

The part of the water barrier wall 40 which part is located higher than the lower end 42 is formed of an upper wall 43 and a lower wall 44 which walls are continuous with each other.

The upper wall 43 has a basal end integrated with the inside surface of the flange portion 24 and covers the gas entry space 46 around the NOx sensor 30 on diagonally upper side (i.e., upper side and radially inner side of the exhaust pipe 20) of the gas entry space 46 to thereby form a shield between the end of the NOx sensor 30 (mainly the sensor cover 36) and the exhaust port 25. Specifically, the upper wall 43 according to this embodiment has a substantially conical shape located diagonally above the end of the NOx sensor 30 to cover the NOx sensor 30 continuously in a range of nearly 180° as viewed from the bottom.

The lower wall 44 has a substantially semi-cylindrical shape, including an upper end integrally joined with the lower end of the upper wall 43 and a lower end corresponding to the lower end 42 of the entire water barrier wall 40. The lower wall 44 covers the gas entry space 46 on the inner side of the gas entry space 46 radially of the exhaust pipe 20, in a range of nearly 180° as viewed from the bottom.

The water barrier wall 40 can be formed of a single casting integrally with the exhaust pipe 20. This allows the number of components to be reduced and allows the water barrier wall 40 to maintain a high strength even at high temperatures, for example, as compared to the case where the water barrier wall 40 and the exhaust pipe 20 are individually formed as respective different components and thereafter joined to each other (for example, by welding).

The water barrier wall 40, furthermore, has a shape forming a gas outlet different from the opening 41 as the gas inlet, the gas outlet letting gas having entered the gas entry space 46 through the opening 41 escape to the space outside the water barrier wall 40 through the gas outlet. Specifically, the lower end 42 is formed with a plurality of cutouts 48 each having a shape penetrating upward at respective positions (two positions in this embodiment) arranged circumferentially of the lower end 42. Each of the cutouts 48 forms the gas outlet providing communication between the inside and the outside of the water barrier wall 40. Specifically, as indicated by the arrow in FIG. 9, each of the cutouts 48 formed in the lower end 42 lets the exhaust gas having entered the gas entry space 46 through the opening 41 defined by the lower end 42 escape, through the cutout 48, to the space inside the exhaust pipe 20 and outside the water barrier wall 40.

According to the above-described exhaust apparatus, the water barrier wall 40 prevents water having entered the exhaust pipe 20 through the exhaust port 25 (for example, rain water and high-pressure cleaning water) from reaching the end of the NOx sensor 30 while allowing the exhaust gas to reach the end of the NOx sensor 30 from beneath through the opening (gas inlet) 41 defined by the lower end 42 of the water barrier wall 40, thereby enabling the NOx sensor 30 to perform normal detection of NOx concentration in the exhaust gas. This eliminates the necessity of such an exhaust pipe having a long and complex shape, for example, as disclosed in JP 2014-163237, for waterproofing the NOx sensor 30 to thereby make it possible to effectively suppress the increase in the size and the cost of the apparatus.

The present invention is not limited to the above-described embodiment. The present invention encompasses, for example, the following mode.

A) Basic Shape of Water Barrier Wall

The water barrier wall according to the present invention can be freely formed into any shape capable of forming a shield between at least the exhaust port of the exhaust pipe and the NOx sensor in the exhaust pipe. For example, the water barrier wall may be formed of a simple flat plate to form the shield. However, a water barrier wall such as the water barrier wall 40 according to the embodiment, that is, a water barrier wall integrated with the exhaust pipe 20 to define the gas entry space 46 around the NOx sensor 30, in association with the exhaust pipe 20, and having a shape including the lower end 42 enclosing the opening (gas inlet) 41 that allows the exhaust gas to enter the gas entry space 46 from the space thereunder and enclosing the gas entry space at a position higher than the lower end can reliably protect the NOx sensor 30 from water while allowing the exhaust gas to enter the gas entry space 46.

In particular, such a water barrier wall having a shape covering the gas entry space 46 on the upper side thereof and the inner side thereof radially of the exhaust pipe 20 as the upper wall 43 and the lower wall 44 shown in FIG. 7 can prevent water having entered the exhaust pipe 20 through the exhaust port 25 from reaching the NOx sensor 30 not only directly but also indirectly due to rebound of waterdrop from the inner surface of the exhaust pipe 20, thereby ensuring the protection of the NOx sensor 30 from water.

B) Gas Outlet of Water Barrier Wall

With respect to the gas inlet and the gas outlet, the water barrier wall according to the present invention only has to form a gas inlet. In other words, the present invention encompasses a mode of a water barrier wall forming no dedicated gas outlet and allowing exhaust gas to be supplied to and discharged from the gas entry space through a common opening. Such a water barrier wall is likely to promote the exhaust gas that has entered the gas entry space to stay in the space; in contrast, a water barrier wall formed with a gas inlet and a gas outlet independently of each other promotes circulation of the exhaust gas through the gas entry space to thereby improve the detection accuracy and responsiveness of the NOx sensor.

The position of the gas outlet is not particularly limited but also permitted, for example, to be configured by a through hole provided in a part higher than the lower end of the water barrier wall. However, the configuration as shown in FIG. 7 in which each of the cutouts 48 formed in the lower end 42 of the water barrier wall 40 forms the gas outlet at a lowermost position has an advantage of more effectively hindering water from reaching the NOx sensor 30 through the gas outlet.

The gas outlet may be brought into communication with the atmosphere (i.e., exterior of the exhaust apparatus) through an auxiliary exhaust pipe other than the exhaust pipe 20. This promotes the exhaust gas to be released from the gas entry space, thereby further improving the detection accuracy and responsiveness. In this case, the front end of the auxiliary exhaust pipe is preferably directed downward or diagonally downward, which makes it possible to prevent more reliably water from entering the gas entry space through the auxiliary exhaust pipe.

C) Position of NOx Sensor

The position of the NOx sensor also can be freely set. For example, the NOx sensor may be retained by an intermediate part of the exhaust pipe. However, retaining the NOx sensor in the upstream end of the exhaust pipe makes it possible to locate the NOx sensor far away from the exhaust port enclosed by the downstream end of the exhaust pipe to thereby ensure the protection of the NOx sensor from water and to bring the exhaust gas into contact with the NOx sensor before the flow speed thereof in the exhaust pipe has been reduced to thereby effectively restrain the exhaust gas from stay around the NOx sensor; this produces an advantage of improving the detection accuracy of a NOx concentration and responsiveness of the NOx sensor. Especially in the case where the upstream end of the exhaust pipe 20 forms a flange portion 24 having a large thickness as in the above embodiment, utilization of the thickness of the flange portion 24 makes it possible to form the sensor retention portion 26 capable of retaining the NOx sensor 30 with a sufficient force without involving a significant increase in the size of the exhaust pipe 20.

D) Shape of Exhaust Pipe

The shape of the exhaust pipe according to the present invention can be freely set. As described above, the protection of the NOx sensor from water can be achieved by the water barrier wall, which allows the limitation of the shape of the exhaust pipe for protecting the NOx sensor to be significantly reduced. For example, the exhaust pipe may either include a part extending horizontally from the aftertreatment device or have a shape merely extending vertically upward from the upper part of the aftertreatment device. In either case, it is possible to locate the exhaust port defined by the downstream end of the exhaust pipe higher than the upstream end to thereby allow the exhaust gas to be smooth released while preventing water from entering the NOx sensor through the exhaust port by the water barrier wall to thereby ensure the normal detection of a NOx concentration by the NOx sensor.

E) Aftertreatment Device

The aftertreatment device according to the present invention widely encompasses any device which performs an aftertreatment of the exhaust gas in relation to the NOx concentration detected by the NOx sensor. For example, the aftertreatment device does not absolutely have to include the aforementioned DPF. Use of the information on the detected NOx concentration is also not particularly limited. The detected NOx concentration may be used for either control of the injection amount of urea water in the SCR system or diagnosis of failure or deterioration of the components of the aftertreatment device.

As described above, provided is an exhaust apparatus to be equipped on a vehicle with an engine to give an aftertreatment to exhaust gas emitted from the engine and to release thereafter the treated exhaust gas into the atmosphere, the exhaust apparatus being capable of normally detecting a nitrogen oxide (NOx) concentration in the exhaust gas for an aftertreatment of the exhaust gas without involving a significant increase in the size and the cost of the apparatus.

The provided apparatus includes: an aftertreatment device connected to the engine and configured to give the aftertreatment to the exhaust gas emitted from the engine; an exhaust pipe having an upstream end connected to the aftertreatment device and a downstream end enclosing an exhaust port at a position higher than the upstream end; a NOx sensor that includes a sensing portion configured to generate a detection signal relating to a NOx concentration in the exhaust gas, through contact with the exhaust gas, the NOx sensor being retained in the exhaust pipe so as to locate the sensing portion inside the exhaust pipe; and a water barrier wall disposed inside the exhaust pipe and having a shape to form a shield between the NOx sensor and the exhaust port while leaving a gas inlet that allows the exhaust gas to flow to the NOx sensor from the upstream end of the exhaust pipe through the gas inlet.

This apparatus is capable of effectively preventing water from adhering to the NOx sensor to thereby allow the NOx sensor to perform a normal detection of the NOx concentration without giving the exhaust pipe great length or complicated shape. Specifically, the water barrier wall included in the apparatus has a shape forming a shield between the NOx sensor and the exhaust port while allowing the exhaust gas to flow to the NOx sensor from the upstream end of the exhaust pipe, thereby making it possible to effectively prevent the water having entered the exhaust pipe through the exhaust port from adhering to the NOx sensor, even when the exhaust pipe has a simple shape, for example, a shape merely extending upward (including diagonally upward) in a range from the upstream end to the downstream end of the exhaust port, while allowing the exhaust gas to flow to the NOx sensor through the gas inlet to come in contact with the NOx sensor, which enables the NOx sensor to perform a normal detection of the concentration in the exhaust gas.

For example, the water barrier wall preferably has a shape being connected to the exhaust pipe to define a gas entry space around the NOx sensor in association with the exhaust pipe, the shape including a lower end enclosing an opening which serves as the gas inlet to allow the exhaust gas to enter the gas entry space from a space beneath the gas entry space through the opening and enclosing the gas entry space at a position higher than the lower end. This shape makes it possible to reliably prevent water having entered the exhaust pipe from adhering to the NOx sensor while allowing the exhaust gas to flow to the NOx sensor through the opening that serves as the gas inlet.

In this case, the water barrier wall preferably includes a part that covers the gas entry space on inner side of the gas entry space, radially of the exhaust pipe. The part is capable of also preventing waterdrop having entered the exhaust pipe and rebounded from the inside surface of the exhaust pipe from indirectly reach the NOx sensor, thereby ensuring the protection of the NOx sensor from water.

The water barrier wall can be formed of a single casting integrally with the exhaust pipe. This allows the number of components to be reduced and allows the water barrier to maintain its high strength even at high temperatures, for example, as compared to the case where the water barrier wall and the exhaust pipe are formed of respective individual components.

The water barrier wall preferably has a shape forming a gas outlet different from the gas inlet, the gas outlet letting gas having entered the gas entry space through the gas inlet escape through the gas outlet to a space outside the water barrier wall. The gas outlet promotes circulation of the exhaust gas in the gas entry space, thereby improving the detection accuracy of the NOx concentration.

The gas outlet is positioned preferably as low as possible in terms of waterproof. For example, if having the lower end enclosing the opening as the gas inlet, the water barrier wall preferably includes a cutout formed in the lower end of the water barrier wall so as to penetrate upward, the cutout forming the gas outlet.

In the case where the NOx sensor further includes a sensor cover that covers the sensing portion and the sensor cover includes an end-side portion located closer to an end of the NOx sensor than the sensing portion, it is preferable that the NOx sensor is retained in the exhaust pipe so as to locate the end-side portion below the sensing portion. This effectively prevents water having condensed (formed condensation) on the surface (particularly the inside surface) of the sensor cover from flowing down to the sensing portion without evaporation.

The NOx sensor is preferably located in the upstream end of the exhaust pipe. This makes it possible to locate the NOx sensor away from the exhaust port enclosed by the downstream end of the exhaust pipe to reliably protect the NOx sensor from water and further to bring the exhaust gas into contact with the NOx sensor before the flow speed of the exhaust gas in the exhaust pipe is reduced to thereby effectively restrain the exhaust gas from staying around the NOx sensor; this makes it possible to improve the detection accuracy of the NOx concentration and responsibility of the NOx sensor.

For example, in the case where the exhaust pipe includes an exhaust pipe body and a flange portion formed in the upstream end of the exhaust pipe and having a greater thickness than that of the exhaust pipe body, it is preferable that the flange portion is formed with a sensor retention portion that retains the NOx sensor. This makes it possible to form a part for retaining the NOx sensor with a sufficient strength while suppressing increase in the size of the exhaust pipe, by utilization of the thickness of the flange.

It is preferable that the exhaust pipe includes a retaining portion that retains the NOx sensor and the NOx sensor includes a retained portion that is retained by the exhaust pipe and that the retaining portion and the retained portion are made of respective materials having respective linear expansion coefficients equal to each other (for example, made of the same stainless steel material). This prevents excess or deficiency of the retaining force of the exhaust pipe for holding the NOx sensor from being caused by the difference in the coefficient of linear expansion.

This application is based on Japanese Patent application No. 2016-065888 filed in Japan Patent Office on Mar. 29, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An exhaust apparatus to be provided on a vehicle with an engine to give an aftertreatment to exhaust gas emitted from the engine and to release thereafter the treated exhaust gas into atmosphere, the exhaust apparatus comprising:

an aftertreatment device connected to the engine and configured to give the aftertreatment to the exhaust gas emitted from the engine;

an exhaust pipe having an upstream end connected to the aftertreatment device and a downstream end enclosing an exhaust port at a position higher than the upstream end, the exhaust port being opened to the atmosphere to allow water to enter the exhaust pipe through the exhaust port;

a NOx sensor that includes a sensing portion configured to generate a detection signal relating to a NOx concentration in the exhaust gas, through contact with the exhaust gas, the NOx sensor being retained in the exhaust pipe so as to locate the sensing portion inside the exhaust pipe; and a water barrier wall disposed inside the exhaust pipe and having a shape to form a shield located between the sensing portion of the NOx sensor and the exhaust port, to prevent the water having entered the exhaust pipe through the exhaust port from adhering to the sensing portion while leaving a gas inlet that allows the exhaust gas to flow to the NOx sensor from the upstream end of the exhaust pipe through the gas inlet, wherein the water barrier wall has a shape connected to the exhaust pipe to define a gas entry space around the NOx sensor in association with the exhaust pipe, the shape of the water barrier wall including a lower end of the water barrier wall, the lower end being located lower than any portion of the NOx sensor such that the NOx sensor does not protrude from the lower end and is enclosed within the water barrier wall, the lower end defining an opening which serves as the gas inlet to allow the exhaust gas to enter the gas entry space from a space beneath the gas entry space through the opening and a cutout in the water barrier wall, the cutout extending upward from the lower end of the water barrier wall to an upper end of the cutout, wherein a portion of the NOx sensor is located lower than the upper end of the cutout.

2. The exhaust apparatus for a vehicle according to claim 1, wherein the water barrier wall includes a part that covers the gas entry space on inner side of the gas entry space, radially of the exhaust pipe.

3. The exhaust apparatus for a vehicle according to claim 1, wherein the water barrier wall is formed of a single casting integrally with the exhaust pipe.

4. The exhaust apparatus for a vehicle according to claim 1, wherein the water barrier wall has a shape forming a gas outlet different from the gas inlet, the gas outlet letting gas having entered the gas entry space through the gas inlet escape through the gas outlet to a space outside the water barrier wall.

5. The exhaust apparatus for a vehicle according to claim 4, wherein the water barrier wall includes a cutout formed in the lower end of the water barrier wall so as to penetrate upward, the cutout forming the gas outlet.

6. The exhaust apparatus for a vehicle according to claim 1, wherein the NOx sensor further includes a sensor cover that covers the sensing portion, and the sensor cover includes an end-side portion located closer to an end of the NOx sensor than the sensing portion, and the NOx sensor is retained in the exhaust pipe so as to locate the end-side portion below the sensing portion.

7. The exhaust apparatus for a vehicle according to claim 1, wherein the NOx sensor is located in the upstream end of the exhaust pipe.

8. The exhaust apparatus for a vehicle according to claim 7, wherein the exhaust pipe includes an exhaust pipe body and a flange portion formed in the upstream end of the exhaust pipe and having a greater thickness than a thickness of the exhaust pipe body, and the flange portion includes a sensor retention portion that retains the NOx sensor.

9. The exhaust apparatus for a vehicle according to claim 1, wherein: the exhaust pipe includes a retaining portion that retains the NOx sensor and the NOx sensor includes a retained portion that is retained by the exhaust pipe; and the retaining portion and the retained portion are made of respective materials having respective linear expansion coefficients equal to each other.

10. The exhaust apparatus for a vehicle according to claim 1, wherein the water barrier wall includes a part conical wall extending inside the portion of the exhaust pipe oriented substantially vertically, the part conical wall being oriented to direct water flowing downward in the portion of the exhaust pipe oriented substantially vertically in a direction away from the gas inlet and the NOx sensor.

* * * * *